US010907919B2

(12) United States Patent
Weilharter

(10) Patent No.: US 10,907,919 B2
(45) Date of Patent: Feb. 2, 2021

(54) FIREARM

(71) Applicant: Rene Weilharter, Ybbs an der Donnau (AT)

(72) Inventor: Rene Weilharter, Ybbs an der Donnau (AT)

( * ) Notice: Subject to any disclaimer, the term of this patent is extended or adjusted under 35 U.S.C. 154(b) by 0 days.

(21) Appl. No.: 16/642,067

(22) PCT Filed: Sep. 20, 2018

(86) PCT No.: PCT/AT2018/060220
§ 371 (c)(1),
(2) Date: Mar. 19, 2020

(87) PCT Pub. No.: WO2019/056037
PCT Pub. Date: Mar. 28, 2019

(65) Prior Publication Data

US 2020/0208931 A1 Jul. 2, 2020

(30) Foreign Application Priority Data

Sep. 22, 2017 (AT) ..... A 50810/2017

(51) Int. Cl.
*F41A 15/16* (2006.01)
*F41A 3/66* (2006.01)
*F41C 3/00* (2006.01)

(52) U.S. Cl.
CPC ..... *F41A 15/16* (2013.01); *F41A 3/66* (2013.01); *F41C 3/00* (2013.01)

(58) Field of Classification Search
CPC .. F41A 15/16; F41A 15/22; F41A 9/54; F41A 3/66; F41C 3/00
(Continued)

(56) References Cited

U.S. PATENT DOCUMENTS 3,882,625 A * 5/1975 Tellie ..... F41A 3/12 42/25
3,952,440 A * 4/1976 Tellie ..... F41A 35/02 42/106

(Continued)

FOREIGN PATENT DOCUMENTS

| | | | |
|---|---|---|---|
| CH | 580269 | B | 9/1976 |
| DE | 102015003628 | A | 9/2016 |
| FR | 3013739 | a | 5/2015 |

*Primary Examiner* — Samir Abdosh
(74) *Attorney, Agent, or Firm* — Andrew Wilford

(57) ABSTRACT

The invention relates to a firearm, comprising: a housing (1) having a barrel (2) arranged therein; a magazine, which can be inserted into a receptacle of the housing and which has cartridges; a breechblock (3), which can be moved relative to the housing (1) in the longitudinal direction of the barrel (2), for conveying cartridges out of the magazine into a cartridge chamber (4) located in the housing, and for conveying cartridge cases (5) from the cartridge chamber (4) to an ejection port (6) after a shot has been fired. An extractor (8), which is connected to the breechblock (3) and is preloaded in the direction of the cartridge case (5) by means of a spring (7), and an ejector (9), which is likewise connected to the breechblock (3), are provided for the ejection of the cartridge cases (5). The ejector (9) is arranged in a cylindrical ejector seat (10). The extractor (8) is arranged on an extractor seat (11), which is arranged for pivoting about the ejector seat (10). The extractor seat (11) can be fastened at different positions along the pivoting path in order to adjust the ejection direction of the cartridge cases (5).

6 Claims, 3 Drawing Sheets

(58) Field of Classification Search
USPC ..... 42/25, 46, 47; 89/196
See application file for complete search history.

(56) References Cited

U.S. PATENT DOCUMENTS

| | | | | | |
|---|---|---|---|---|---|
| 4,648,190 | A * | 3/1987 | Allen | F41A 3/10 | 42/23 |
| 7,395,626 | B2 * | 7/2008 | Zedrosser | F41A 15/14 | 42/25 |
| 8,037,805 | B1 * | 10/2011 | Neroni | F41A 3/28 | 89/196 |
| 8,362,087 | B2 * | 1/2013 | Embrechts | A61K 31/165 | 514/621 |
| 9,182,184 | B2 * | 11/2015 | Emde | F41A 9/65 | |
| 2014/0068985 | A1 * | 3/2014 | Emde | F41C 3/00 | 42/6 |

* cited by examiner

Fig. 7
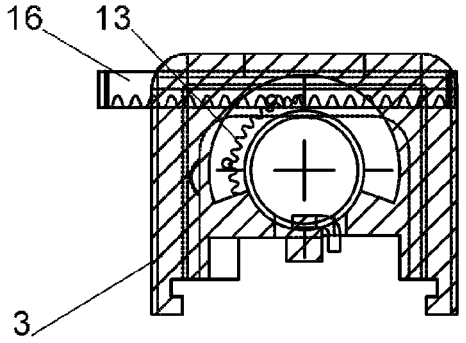
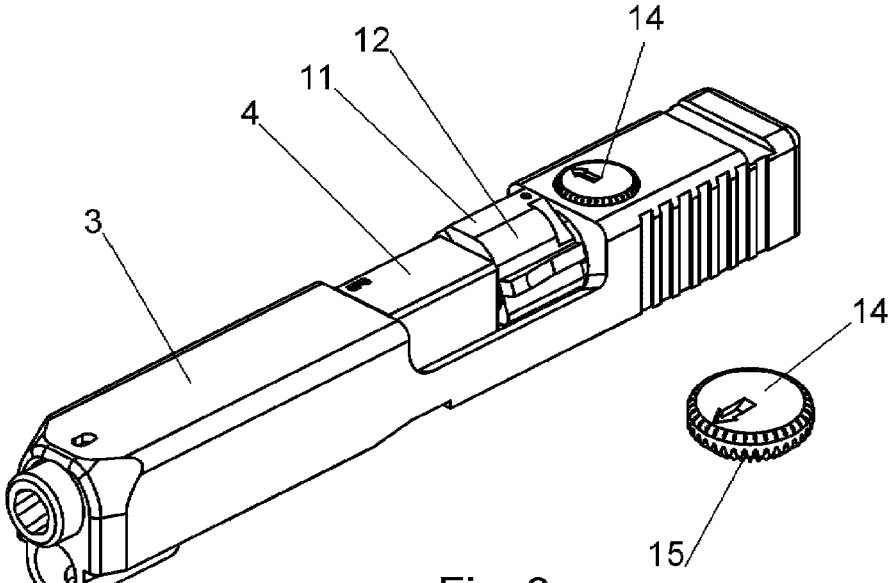
Fig. 8

FIREARM

CROSS REFERENCE TO RELATED APPLICATIONS

This application is the US-national stage of PCT application PCT/AT2018/060220 filed 20 Sep. 2018 and claiming the priority of Austrian patent application A50810/2017 itself filed 22 Sep. 2017.

TECHNICAL AREA

The invention concerns a firearm comprising a frame carrying a barrel, a magazine with cartridges that is insertable into a magazine well of the frame, a breech slide movable relative to the frame longitudinally of the barrel for moving cartridges out of the magazine into a chamber in the frame, as well as, after firing, for moving the cartridge cases from the chamber to an ejection port, with an extractor that is connected to the breech slide and is biased toward the cartridge case by a spring, as well as an ejector that is connected with the breech slide being provided.

STATE OF THE ART

After a shot has been fired by a semiautomatic firearm, the empty cartridge case is carried to an ejection port through a movable breech slide and is ejected, and thereafter, upon the return of the breech slide to the closed position, a new cartridge is moved from a magazine into the chamber, whereupon the weapon is again ready to fire. Since most users are right handed, these ejection ports are mostly on the right side of the weapon so that the cartridge case is projected on ejection by the user without obstructing it. However, the position of the ejection port is not suitable for every intended application. Left-handed people obviously need the ejection port on the other side, but some situations can also arise in other applications, such as with firearms installed on vehicles, or there can be situations in which it would be of advantage to move the ejection port to another place.

The reconstruction of a weapon from right-handed to left-handed operation usually requires some parts of the weapon to be exchanged entirely and to thus be custom made for the user. There are many prior-art attempts to meet this problem and to create a firearm in which the position of the ejection port for the cartridge cases can be switched between the right and the left side. Many of these solutions derive from the fact that the weapon must be at least partly disassembled and that some parts must be exchanged or at least reinstalled in a different position. Those designs that allow for a changeover between right and left ejection ports without reconstruction, are structurally complex, since many parts of the ejectors are doubly installed, so it becomes possible to put just one of the two sides into operation by a selector. But this results in higher production costs and also in a lowered functional reliability due to the numerous additional parts.

For example, the Patcit 0001: DE 2402445 [U.S. Pat. No. 3,882,625] describes an embodiment of a firearm in which two symmetrically disposed seats are provided in the breech slide so that the extractor of the ejector can be installed in one or the other seat and the ejection of the cartridge cases can take place to the right or to the left. It is however a disadvantage of this configuration that switching between ejection on the right and on the left still requires several manual operations and that the structure is complicated and error-prone. It is always necessary to remove a safety catch from the unused hole to perform the exchange; the ejector is then removed longitudinally of the barrel from its position and is reinserted into the other free seat. The safety must then be reinstalled. Aside from the still complicated procedure and the need to provide a second seat in the barrel, this configuration only makes it possible to select between two different ejection positions. It is not possible to set a certain ejection angle or to use an additional ejection position, for example upward, with this configuration.

DESCRIPTION OF THE INVENTION

It is therefore an object of the present invention to provide a firearm that resolves the above-described disadvantages and that allows for a fast adjustment of the ejection position of the cartridge cases. The firearm should also be constructed as simply as possible, so that it has a high functional reliability and is easily manufactured. It should ideally be possible to perform the switching operation with just one movement and it should be possible to set a custom ejection angle for the cartridge cases.

This object is attained by the present invention in that the ejector is in a cylindrical ejector seat and in that the extractor is in an extractor seat that pivot about the ejector seat, with the extractor seat being fixable at different positions along its pivot path for purposes of setting the ejection direction of the cartridge cases. The ejector seat and the ejector can be installed as in conventional firearms, with the cylindrical ejector seat simultaneously serving as the axis of rotation for the extractor seat. This also only requires a single extractor that is can always open in the direction in which the cartridge case is to be ejected by pivoting the extractor seat. A single manual adjuster effects the adjustment of the ejection direction takes place by a single manually operable element by the user who rotates the extractor seat in the appropriate direction.

It is a further advantageous characteristic that the extractor seat has ledges that serve as end stops for limiting the pivoting range of the extractor seat. It is, for example, possible for lateral ledges in the form of protrusions to serve as end stops that are struck on the respective side of the breech slide when the maximum lateral position is reached. The direction of ejection for a conventional handgun can then be set at an angle of 110° between the left and the right end stop. The position of the ejector thus always stays in the central position, while it is only the position of the extractor that is changed.

In accordance with another advantageous characteristic, it is foreseen that at least one spring-mounted catch is in the extractor seat and that several recesses respective with the catches are included along the pivot path of the extractor seat for setting the position of the ejection direction. It is clear to the average person skilled in the art that, depending on the application, it is naturally also possible for the catch to be located on the breech slide and the respective recesses on the extractor seat. A configuration with ball catches makes for a particularly economical design in that several adjustment possibilities for the ejection position are realizable depending on the number of catch positions that are provided.

It is furthermore another advantageous characteristic that a rack is connected with the extractor seat and is coupled with an adjuster that is movably mounted on the breech slide, so that, on actuating the adjuster, the ejection direction is adjustable and settable by pivoting the extractor seat. Continuous positioning of the ejection direction can be achieved with an adjustment via a rack that is adjustable by an appropriate adjuster that furthermore makes it possible to keep the design as simple as possible and to perform the setting with a single manipulation.

In accordance with one possible embodiment, it is possible to provide the breech slide with an adjuster formed by a gear segment having teeth engaging the teeth of the rack. A linkage of this design would be particularly easy to implement. It is thus possible to select an ejection position via the rack/gear assembly on a top side of the breech slide.

It is finally a characteristic of a further alternative embodiment that a toothed rack is provided whose teeth engage the teeth of the rack and that is disposed on the breech slide and is movable transversely of the direction of motion of the breech slide. In this embodiment, the toothed rack can be disposed in suitable lateral recesses of the breech slide and it can be actuated by pressing one of the two free ends projecting out of the breech slide.

BRIEF DESCRIPTION OF THE DRAWING

The invention will now be described in greater detail based on the following embodiments as well as the attached drawing that shows in.

WAY(S) OF IMPLEMENTING THE INVENTION

Figure 1:
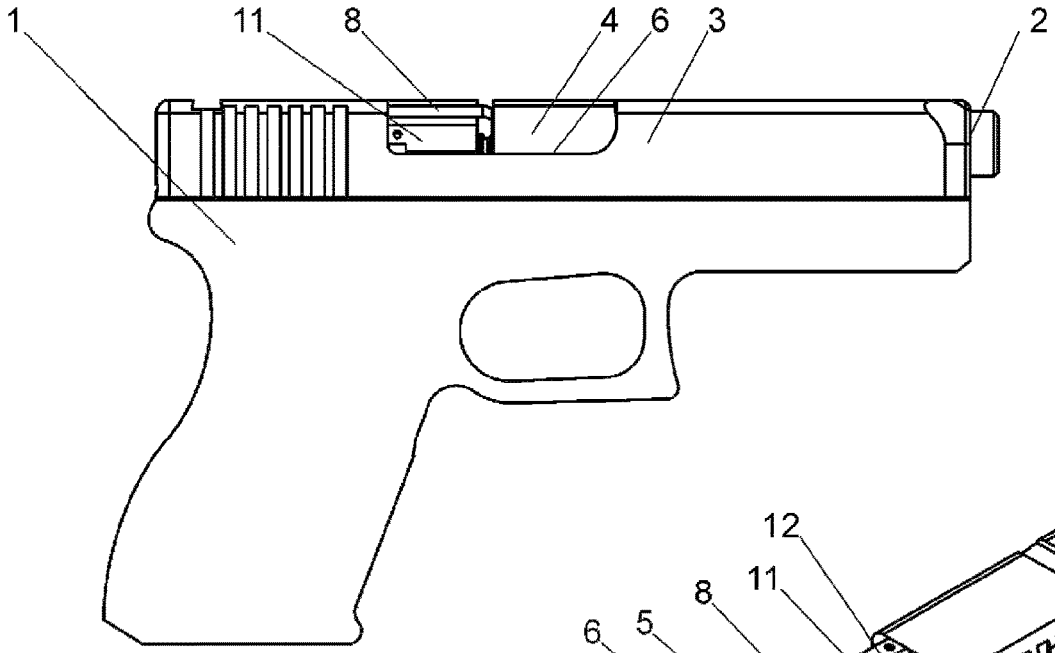
FIG. 1 a schematic side view of a firearm in accordance with the invention with a closed breech slide, FIG. 2 a schematic perspective view of the breech slide and the ejector, FIG. 3 the breech slide of FIG. 2 without a cartridge case, FIG. 4 a cross-sectional view of the breech slide of FIG. 3, FIG. 5 another cross-sectional view of the breech slide with the opposite ejection position, FIG. 6 a schematic detail longitudinal cross-section of an extractor claw, FIG. 7 a schematic view of a possible embodiment of a adjuster, and FIG. 8 a schematic perspective view of a further possible embodiment of a adjuster.

FIG. 1 is a schematic drawing of a handgun having a frame 1 and a barrel 2. The top side has a breech slide 3 that is movable with respect to the frame 1 to shift cartridges from the magazine into the chamber 4. The empty cartridge cases 5 are furthermore moved by the breech slide to the ejection port 6, in that an ejector 9 collaborates with an extractor 8 in order to project the cartridge case out of the ejection port 6.

Figure 2:
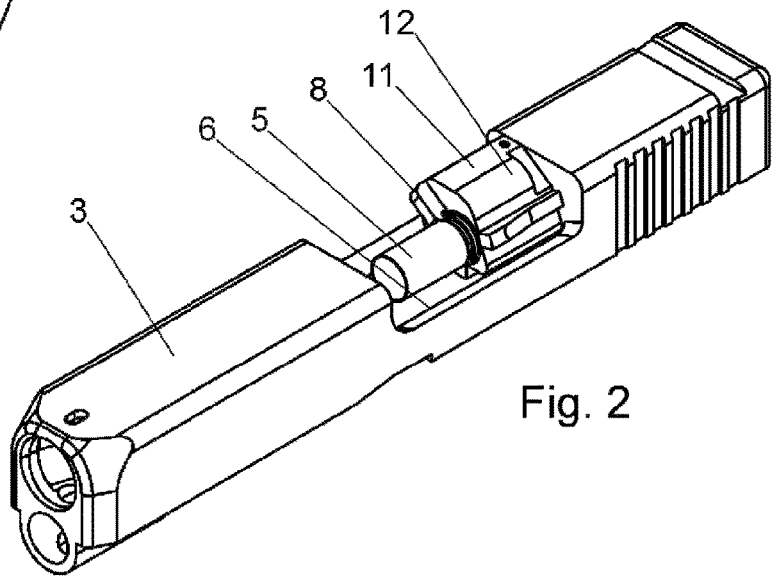
Figure 3:
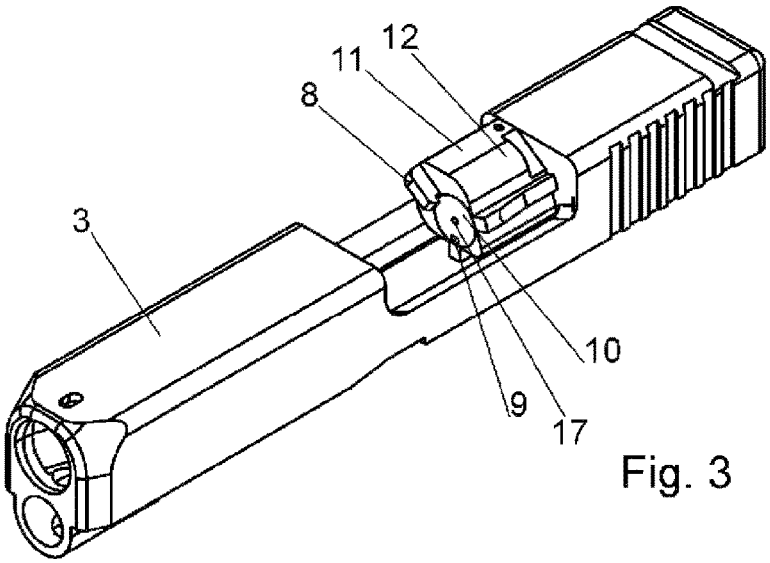

FIGS. 2 and 3 only show the breech slide 3 with the ejector, and to provide a better view the other parts of the firearm are not shown. FIG. 2 shows a cartridge case 5 in its position, but the cartridge case 5 is not shown in FIG. 3. The ejector is behind the ejection port 6. This mechanism comprises an ejector seat 10 that is cylindrical and has an axial hole 17 through which the firing pin can pass. The ejector 9 is installed in a central position in the ejector seat 10.

The extractor seat 11 is disposed around the ejector seat 10, with the ejector seat 10 simultaneously serving as the axis of rotation for the extractor seat 11. The extractor 8 rests in the extractor seat 11.

Figure 4:
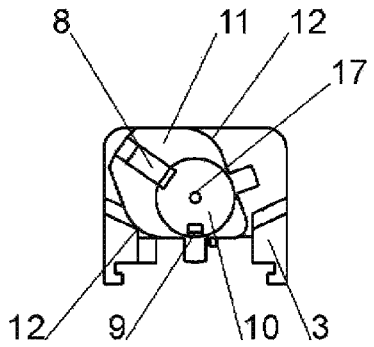
Figure 5:
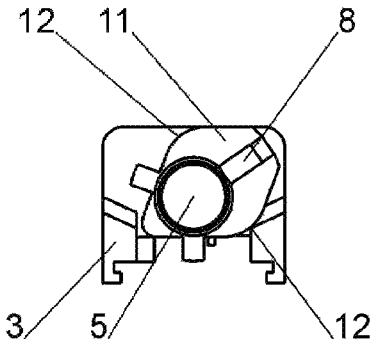

FIGS. 4 and 5 are cross-sectional views of the breech slide 3, with the extractor seat 11 and thus the extractor 8 shown in the two outermost positions for left and right-side ejection of the cartridge case 5. The extractor seat 11 has lateral projecting ledges 12 that form the end stop with the corresponding edges of the breech slide 3. As particularly evident from FIG. 4, the position of the ejector 9 is not changed, but rather only the position of the extractor 8 with respect to the ejector 9 by rotating the extractor seat 11.

Figure 6:
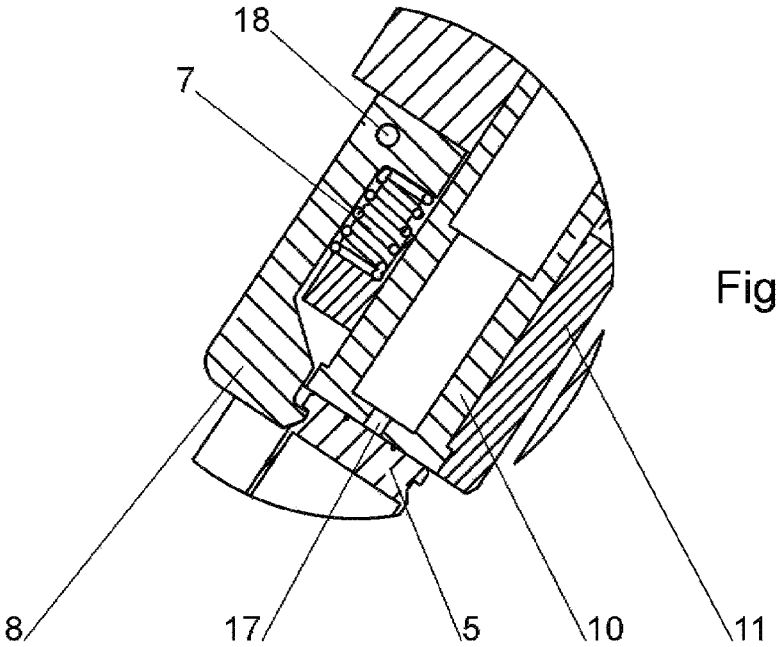

The cross-sectional view of FIG. 6 shows the mounting of the extractor 8 in greater detail. The extractor 8 is mounted in the extractor seat 11 via a pin 18 that is simultaneously the axis of rotation of the extractor 8. A spring 7 supported between the extractor 8 and the extractor seat 11 biases the extractor 8 toward the cartridge case 5 so that it is securely grasped at the lower edge and is pulled out of the chamber 4 after firing.

In the simplest case, the user can simply switch the extractor seat 11 from one ejection direction to the other by hand, with corresponding stop positions in addition to the two end positions for setting the exact ejection positions between the extractor seat 11 and the breech slide 3. FIGS. 7 and 8 show additional embodiments. In the case of the alternative according to FIG. 7, a rack 13 is connected to the extractor seat 11 and a movable toothed rack 16 that engages the rack 13, is disposed on the top of the breech slide 3. The rack 16 lies across the direction of movement of the breech slide 3 and projects from the breech slide 3 on both sides. If the user pushes on the free end of the rack 16 that sticks out more, the extractor seat 11 is pivoted since it is coupled with the rack 13.

In accordance with the embodiment according to FIG. 8, a helical bevel gear 14 that engages the rack 13 with its teeth 15, is in the breech slide instead of the toothed rack 16. The rack 13 and therewith the extractor seat is consequently pivoted continuously by turning the helical bevel gear 14. To provide a better view, the helical bevel gear 14 is shown as a separate component in FIG. 8.

The invention claimed is:

1. A firearm comprising
- a frame,
- a barrel carried thereon,
- a magazine with cartridges that is inserted into a magazine well of the frame,
- a breech slide movable relative to the frame longitudinally of the barrel for moving a cartridge out of the magazine into a chamber in the frame, as well as for moving a cartridge case from the chamber to an ejection port after a shot has been fired,
- an extractor connected to the breech slide and is biased toward the cartridge case by a spring, and
- an ejector also connected to the breech slide for the ejecting the cartridge case and in a cylindrical ejector seat, the extractor being in a pivotal extractor seat securable at different positions along its pivot path in order to adjust the ejection direction of the cartridge cases.

2. The firearm according to claim 1, wherein the extractor seat has ledges that serve as end stops for limiting pivoting of the extractor seat.

3. The firearm according to claim 1, further comprising:
- a plurality of spring-loaded catches in the extractor seat, and
- a plurality of recesses allocated to the catches are provided in the breech slide along the pivot path of the extractor seat for setting the positions of the ejection direction.

4. The firearm according to claim 1, further comprising:
- a rack connected to the extractor seat, and
- an adjuster coupled to the extractor seat, the rack being mounted on the breech slide so that it is movable and the ejection direction is adjustable and settable by pivoting the ejection seat on actuation of the adjuster.

5. The firearm according to claim 4, wherein the adjuster is a bevel gear on the breech slide and having teeth engaging teeth of the rack.

6. The firearm according to claim 4, wherein a toothed rack on the breech slide and slidable transversely to a direction of motion of the breech slide has teeth engaging the teeth of the rack.

* * * * *